US006966798B1

(12) United States Patent
Wu

(10) Patent No.: US 6,966,798 B1
(45) Date of Patent: Nov. 22, 2005

(54) JACK WITH FOOLPROOF MEMBER FOR SELECTIVELY RESTRICTING PLUG INSERTION

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/039,016

(22) Filed: Jan. 18, 2005

(51) Int. Cl.[7] ..... H01R 13/64
(52) U.S. Cl. ..... 439/677; 439/680; 439/676
(58) Field of Search ..... 439/677, 680, 439/681, 676, 344, 374

(56) References Cited

U.S. PATENT DOCUMENTS 6,257,935 B1 * 7/2001 Zhang et al. ..... 439/680
6,296,528 B1 10/2001 Roberts et al.
6,312,293 B1 * 11/2001 Wang ..... 439/677
6,319,070 B1 * 11/2001 Tan ..... 439/680
6,350,156 B1 2/2002 Hasircoglu et al.
6,350,157 B1 2/2002 Mizusawa
6,659,809 B2 * 12/2003 Wang et al. ..... 439/680
2002/0146114 A1 10/2002 Kameya et al.
2004/0224565 A1 * 11/2004 Wan et al. ..... 439/680

FOREIGN PATENT DOCUMENTS

TW 576571 2/2004

* cited by examiner

*Primary Examiner*—Hien Vu
(74) *Attorney, Agent, or Firm*—Wei Te Chung

(57) ABSTRACT

A modular jack (100) includes a housing defining a receiving space (10) and an anti-mismating member (4) assembled to the housing. The anti-mismating member includes a connecting wall (41), at least one retention means (43, 44, 45) extending from the connecting wall and at least a pair of prongs (42) exposed in the receiving space. Each prongs has a main body (421) with an inner stopping portion (422) for blocking an undersized plug (300) and an outer guiding portion (423) for being urged to deflect the main body by a full sized plug (200). The retention means snaps the housing to create a retention force for securing the anti-mismating member in position when the undersized plug is blocked by the stopping portions.

8 Claims, 10 Drawing Sheets

JACK WITH FOOLPROOF MEMBER FOR SELECTIVELY RESTRICTING PLUG INSERTION

BACKGROUND OF THE INVENTION

1. Field of the Invention

The present invention relates to an electrical connector, and more particularly to a modular jack with foolproof member for permitting proper insertion of a full sized plug and preventing erroneous insertion of an undersized plug.

2. Description of the Prior Art

Modular jacks and plugs for use in the communications and computer industries are well known. Nowadays, there are generally two types, that is, smaller sized RJ-11 jacks and plugs and larger sized RJ-45 jacks and plugs. Of course, each of these kJ-11 and RJ-45 jacks are intended to receive only an RJ-11 or RJ-45 plug, respectively. However, the RJ-11 and RJ-45 jacks are often located side by side and frequently placement of the RJ-11 and RJ-45 jacks within electronic equipment is in a location which does not lend themselves to easy visual inspection. Thus, it is possible that during blind installation of a plug into a jack, an operator may incorrectly align an RJ-45 plug with an RJ-Il jack or an RJ-11 plug with an RJ-45 jack. In actual use, due to the size differential, misaligning an RJ-45 plug with an RJ-11 jack is of little concern because an operator will quickly notice that the RJ-45 plug is larger than a plug receiving cavity of the RJ-11 jack. However, misalignment of an RJ-11 plug with an RJ-45 jack creates a serious concern. The RJ-11 plug will fit within the RJ-45 jack, often quite comfortably. In such an event, an operator will actually hear audible click of the RJ-11 plug latch snapping into place within the RJ-45 jack and feel what seems to be proper mating of a plug within a jack. Moreover, the RJ-11 plug will be inserted far enough into the RJ-45 jack to allow contacts of the RJ-11 plug to electrically engage terminals of the RJ-45 jack. This can lead to severe damage to the electronic equipment because certain RJ-11 plug contacts may be carrying higher current than the electronic equipment circuitry which is intended to receive from a respective electrically engaged RJ-45 jack terminal. Accordingly, providing an RJ-45 jack which can effectively prevent errouneous insertion of an RJ-11 plug is conspicuously needed.

One method of addressing the above-mentioned problem is provided in U.S. Pat. No. 6,296,528 B1 which discloses a modular jack with feature for selectively restricting plug insertion. A stop surface is provided incorporated with a flexible stop member. A more forwardly positioned sliding surface is provided also incorporated with the flexible stop member. When an undersized plug is inserted into the modular jack, a leading edge of the undersized plug contacts the stop surface and is prevented from full insertion. When a full sized plug is inserted into the modular jack, a leading edge of the full sized plug contacts the sliding surface before reaching the stop surface and causes the sliding surface to move relative to the leading edge of the full sized plug. The movement produces a subsequent movement of the flexible stop member and the stop surface incorporated thereon, such that the stop surface is located out of engagement with the leading surface of the full sized plug, and full insertion of the full sized plug into the modular jack is permitted. However, the single cantilevered flexible stop member seems too weak to take on restricting function when the undersized plug is inserted into the modular jack. The flexible stop member has a great chance of break down when exerted by a strong insertion force of the undersized plug or repeatingly attempt to insert the undersized plug into the modular jack.

Another method of addressing the above-mentioned problem is provided in Kameya et al., U.S. Patent Publication No. 2002/0146114 A1 which discloses a modular jack. The modular jack comprises an insulative housing and a pair of foolproof member provided on an upper portion of the housing. Especially referring to FIG. 3 of Kameya et al., the housing defines a pair of horizontal grooves at a top wall thereof, a pair of vertical slots communicated with front ends of the grooves and a pair of vertical slits communicated with rear ends of the grooves. Each foolproof member comprises a fixing section press-fitted in the vertical slit to secure the foolproof member in position, a flat spring section extending along bottom of the horizontal groove, and an abutment section located in the vertical slot. The abutment section has a cam portion and a stopper portion located behind and inside the cam portion. Similar to the above description, when an undersized plug is inserted into the modular jack, a leading edge of the undersized plug abuts against the stopper portions to prevent fully insertion of the undersized plug. When a full sized plug is inserted into the modular jack, a leading edge of the full sized plug contacts the cam portions to move the abutment sections upwardly, permitting fully insertion of the full sized plug. However, a problem exists with the modular jack in that fixation between the fixing sections of the foolproof member and the vertical slits of the housing greatly increases the complexity resulting in a complicated assembling process. Additional, especially referring to FIGS. 7A–7C of Kameya et al., it should be pointed out that when the leading edge of the full sized plug abuts on the cam portions to move the abutment sections upwardly, the movement produces a subsequent movement in the flat spring sections which ultimately show themselves in an inclined station, thereby causing the fixing sections to lean to forwardly incline. However, during the spring sections moving upwardly, since the fixing sections press-fit into the vertical slits and should not occur any movement, resistive forces will be inevitably created and transferred to the connections between the flat spring sections and the fixing sections, thus the connections are inclined to fatigue and will become more prominent after a period use so as to unfortunately break.

Hence, a modular jack with an improved foolproof member adapted for permitting proper insertion of a full sized plug and preventing erroneous insertion of an undersized plug is desired to overcome the disadvantages of the prior arts.

BRIEF SUMMARY OF THE INVENTION

Therefore, an object of the present invention is to provide a modular jack having an improved foolproof member for permitting proper insertion of a full sized plug and preventing erroneous insertion of an undersized plug.

To fulfill the above-mentioned objects, a modular jack is provided according to the present invention for permitting proper insertion of a full sized plug and preventing erroneous insertion of an undersized plug. The modular jack comprises an insulative housing defining a receiving space, a plurality of terminals received in the receiving space and an anti-mismating member assembled to the housing. The anti-mismating member comprises a connecting wall and at least a pair of prongs extending from the connecting wall. Each prong has a cantilevered main body with an inner stopping portion for blocking the undersized plug and an outer guiding portion for being urged to deflect the main body by the full sized plug. The anti-mismating member further comprises retention means formed in one of first and second positions thereof. When the retention means formed in the first position, the retention means extends with the prongs in a back-to-front direction and snaps the housing to create an retention force for securing the anti-mismating member in position when the undersized plug is blocked by the stopping portions of the prongs. When the retention means formed in the second position, the retention means extends in a slantwise direction aslant to the back-to-front direction and abuts against the housing to create an retention force for securing the anti-mismating member in position when the undersized plug is blocked by the stopping portions of the prongs.

Other objects, advantages and novel features of the invention will become more apparent from the following detailed description when taken in conjunction with the accompanying drawings.

DETAILED DESCRIPTION OF THE PREFERRED EMBODIMENT

Figure 1:
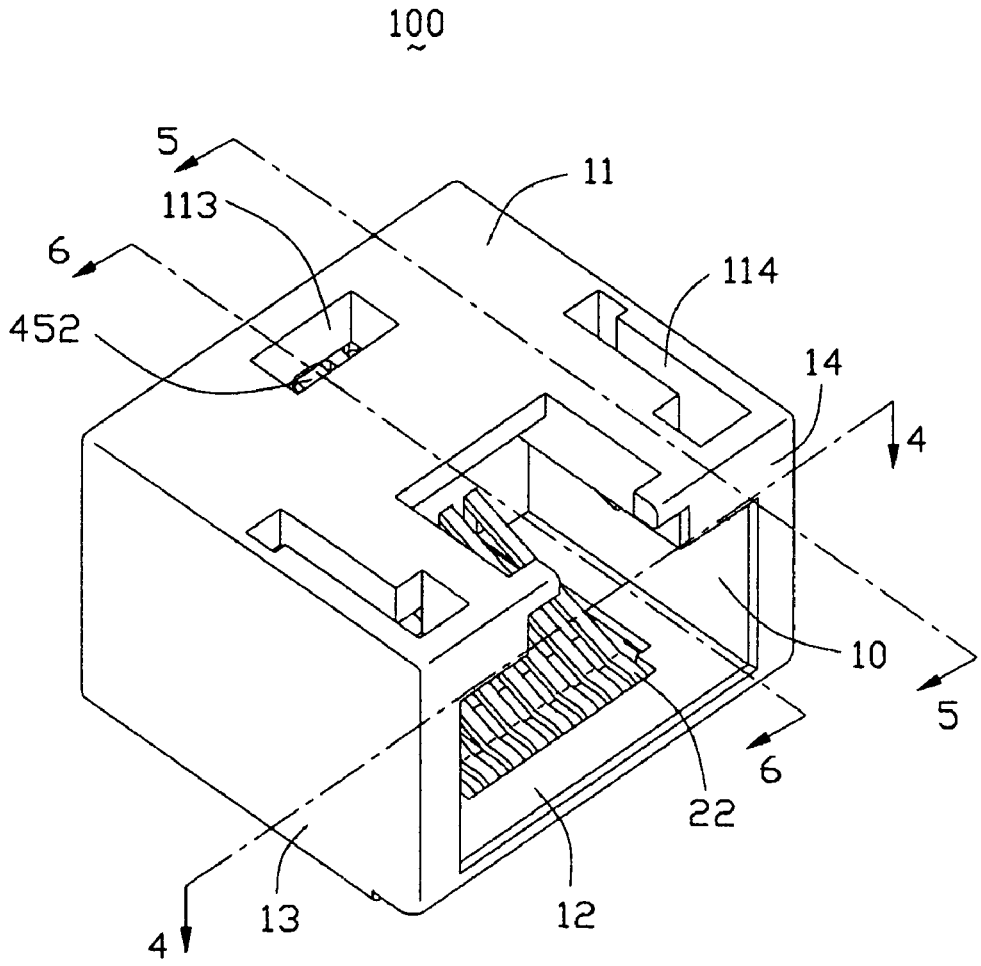
FIG. 1 is an assembled, perspective view of a modular jack according to the present invention.
Figure 2:
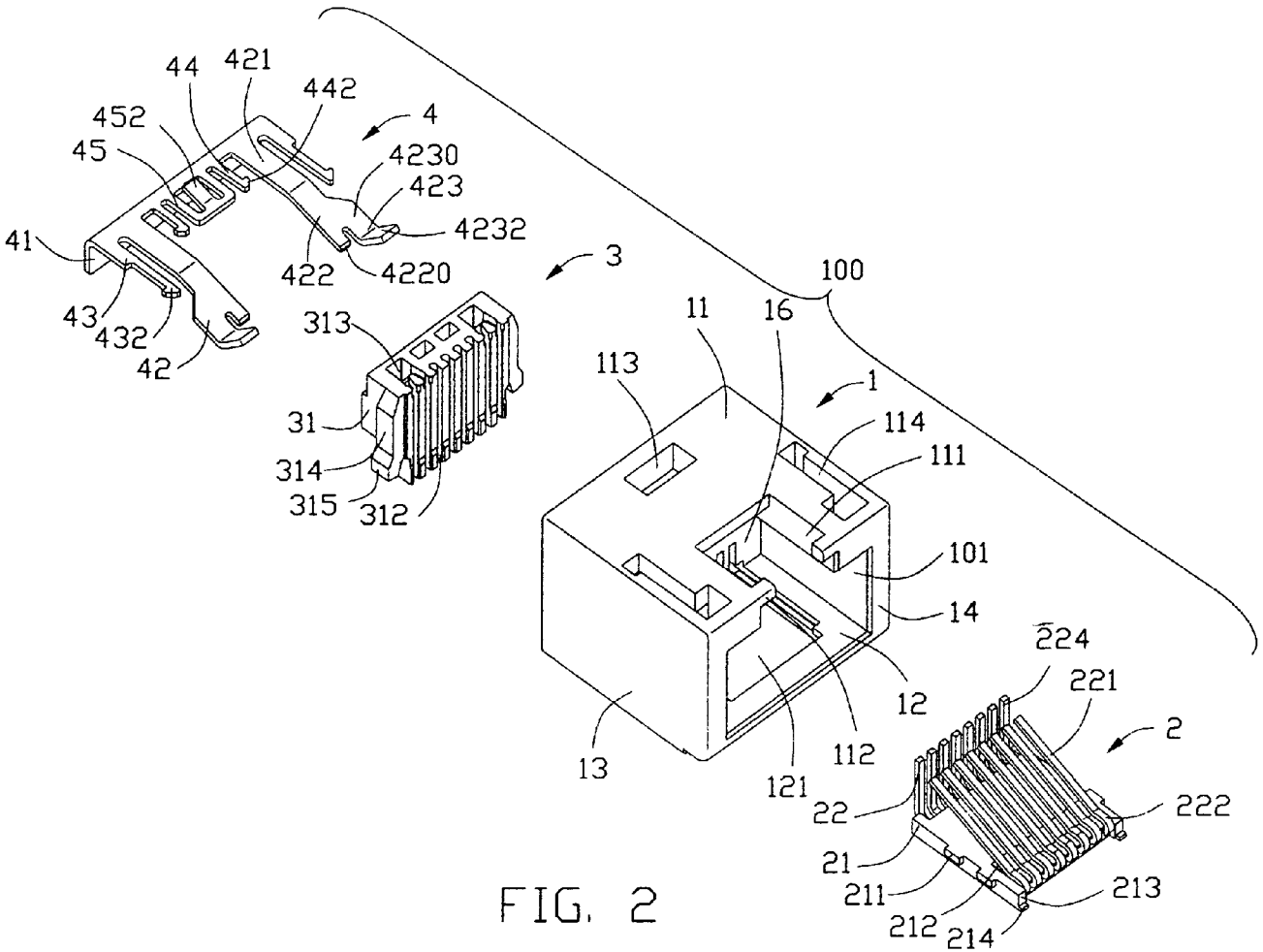
FIG. 2 is an exploded, perspective view of the modular jack of FIG. 1.
Figure 3:
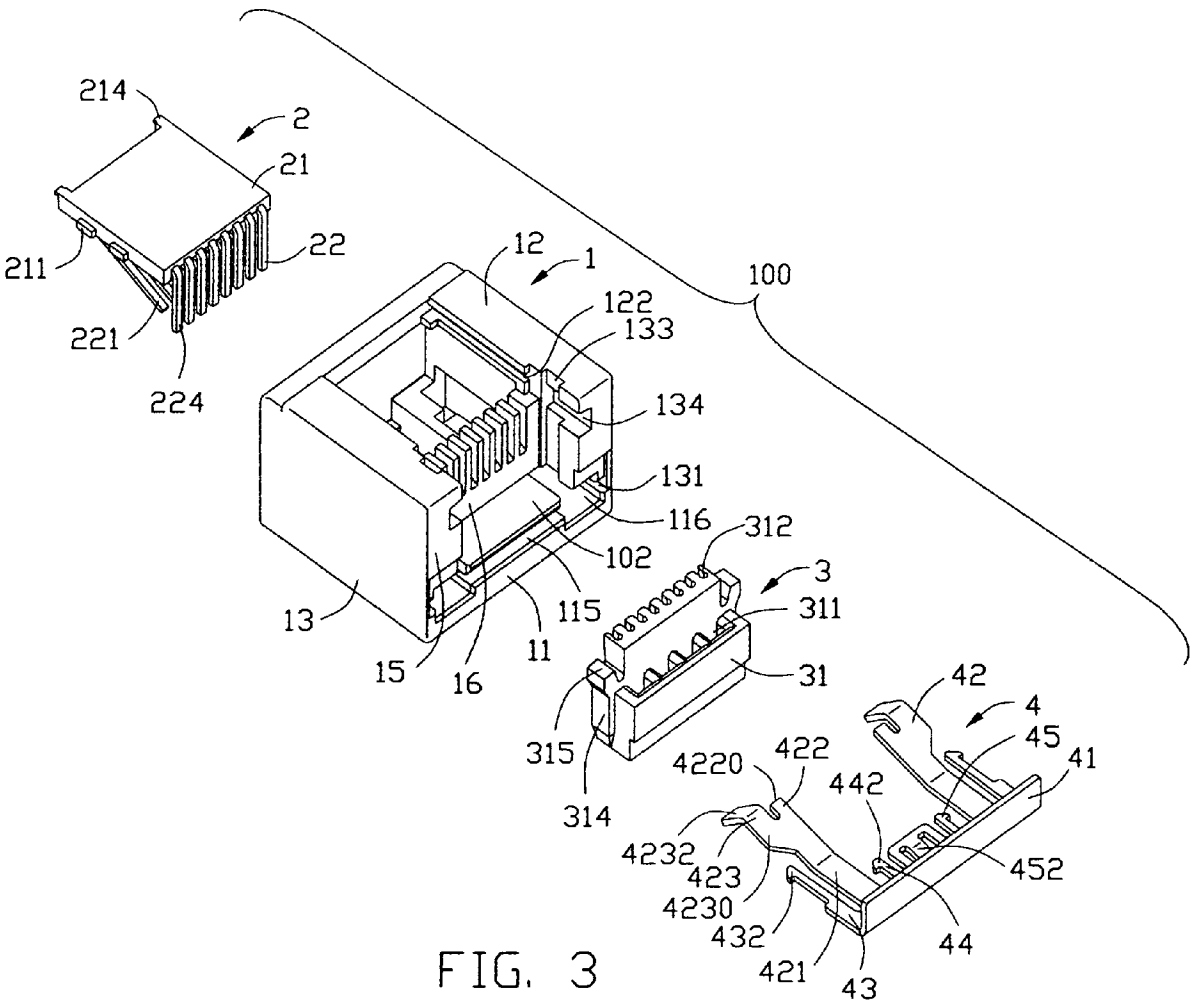
FIG. 3 is a view similar to FIG. 2, but taken from another aspect.
Figure 9:
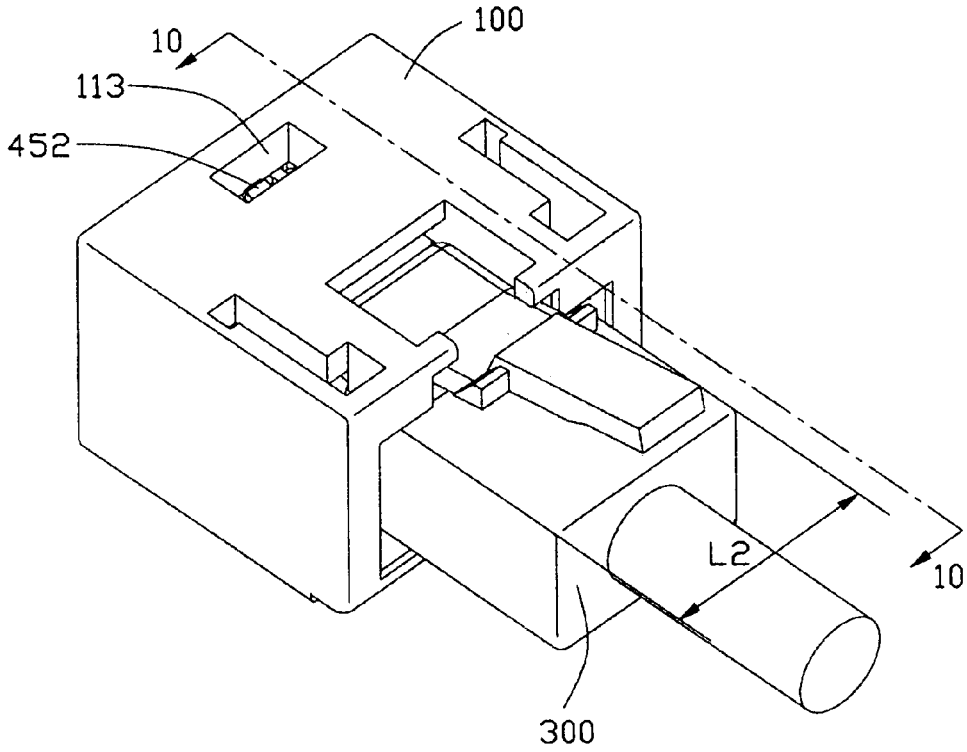
FIG. 9 is a perspective view illustrating how an undersized plug is prevented from insertion into the modular jack.

Referring to the drawings in greater detail, and first to FIGS. 1–3, a modular jack 100 in accordance with the present invention comprises an insulative housing 1, a terminal insert 2 retained in the housing 1, a spacer 3 assembled to the housing 1 behind the terminal insert 2, and an anti-mismating member 4 secured to the housing 1 for permitting proper insertion of a full sized plug such as a standard RJ-45 plug 200 (FIG. 7) and preventing erroneous insertion of an undersized plug such as a standard RJ-11 plug 300 (FIG. 9). It is generally speaking that the RJ-45 plug 200 has a first width L1 (FIG. 7), while the RJ-11 plug 300 has a second width L2 (FIG. 9) smaller than the first width L1.

Referring to FIGS. 2 and 3 in conjunction with FIG. 1, the housing 1 is generally rectangular and is unitarily molded of dielectric material such as plastic or the like. The housing 1 comprises an upper wall 11, a lower wall 12 and a pair of sidewalls 13. The upper wall 11, the lower wall 12 and the sidewalls 13 together surround a receiving space 10 which extends from a front face 14 to a rear face 15 of the housing 1. A first cutout 111 is defined at front middle region of the upper wall 11 and cut from the front face 14 with a pair of retention tabs 112 located at entrance of the first cutout 111. A second cutout 121 is cut from the rear face 15 and substantially through the lower wall 12. A comb-like vertical partition 16 is formed between the sidewalls 13 and divides the receiving space 10 into a plug-receiving cavity 101 and an insert-receiving cavity 102. The upper wall 11 defines a rectangular aperture 113 at rear middle region thereof to communicate with the insert-receiving cavity 102 and a pair of L-shaped notches 114 at front regions thereof proximate corresponding sidewalls 13 to communicate with the plug-receiving cavity 101.

Next, referring to FIGS. 2 and 3 in conjunction with FIG. 4, an inner structural description of the housing 1 will be described in great detail. The housing 1 is provided with a horizontal upper channel 115 extending forwardly through middle region of the upper wall 11 from the rear face 15 and beyond the vertical partition 16, a pair of first grooves 116 recessed upwardly from the plug-receiving cavity 102 and defined at opposite sides of the upper channel 115, and a pair of second grooves 131 respectively recessed in the sidewalls 13. The upper channel 115, the first grooves 116 and the second grooves 131 communicate with one another and together form a space for receiving the anti-mismating member 4. A pair of rectangular bulges 117 is formed at the entrance of the upper channel 115. A pair of rectangular protrusions 132 is formed on the way of the second grooves 131 and symmetrically extend toward each other. The housing 1 further provides a lower channel 122 in the bottom wall 12 ahead and below the vertical partition 16 in the back-to-front direction, a pair of vertical slots 133 defined in opposite inner sidewalls 13 behind and adjacent to the vertical partition 16, and a pair of horizontal grooves 134 defined in align with the lower channel 122 and intersected with the vertical slots 133 for guiding the spacer 3 in the housing 1.

Figure 6:
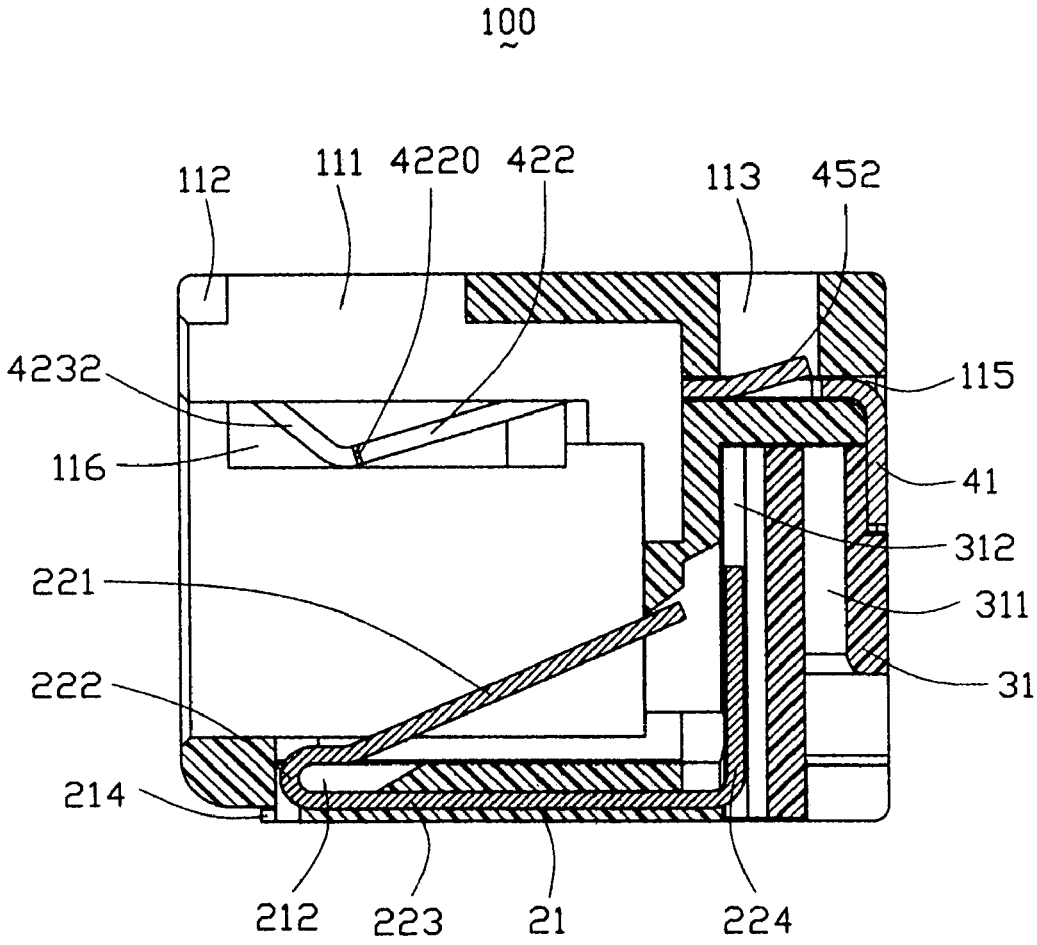
FIG. 6 is a cross-sectional view taken along line 6—6 of FIG. 1.

Referring to FIGS. 2 and 3 in conjunction with FIG. 6, the terminal insert 2 comprises a base 21 and a plurality of terminals 22. The base 21 is made of insulative material such as plastic, and forms a pair of side portions 211 spaced arranged on each side thereof for securing the terminal insert 2 to the housing 1. The base 21 is partially cut to define a rectangular recessed area 212 in a front region thereof, thus, a pair of stopping faces 213 are formed at front and lateral ends of the base 21 spaced by the recessed area 212. Each stopping face 213 forms a mini pad 214 extending forwardly from lower portion thereof. The terminals 22 are insert molded in the base 21 and each comprises a retaining portion 223 insert molded in the base 21, a bent portion 222 formed at a front of the retaining portion 223 and located in the recessed area 212, a contacting portion 221 extending obliquely and rearwardly from the bent portion 222 at an acute angle for mating with a corresponding contact of the standard RJ-45 plug 200, and a tail portion 224 extending upwardly and perpendicularly to the retention portion 223 for electrically connecting with a corresponding wire (not shown) received in the spacer 3.

Referring to FIGS. 2 and 3, the spacer 3 has a body 31 defining a plurality of substantially L-shaped vertical passageways 311 and a plurality of vertical alleyways 312. The L-shaped passageways 311 are defined in front and upper portions of the body 31 and intersected a plurality of windows 313 at upper surface of the body 31. The alleyways 312 are vertically run through the body 31 and communicate with the L-shaped passageways 311 via the windows 313. A pair of positioning ribs 314 is integrally formed on opposite sides of the body 31. Each positioning rib 314 has a latch 315 on lower end thereof and extending outwardly for engagingly received in a corresponding groove 134 of the housing 1.

Figure 4:
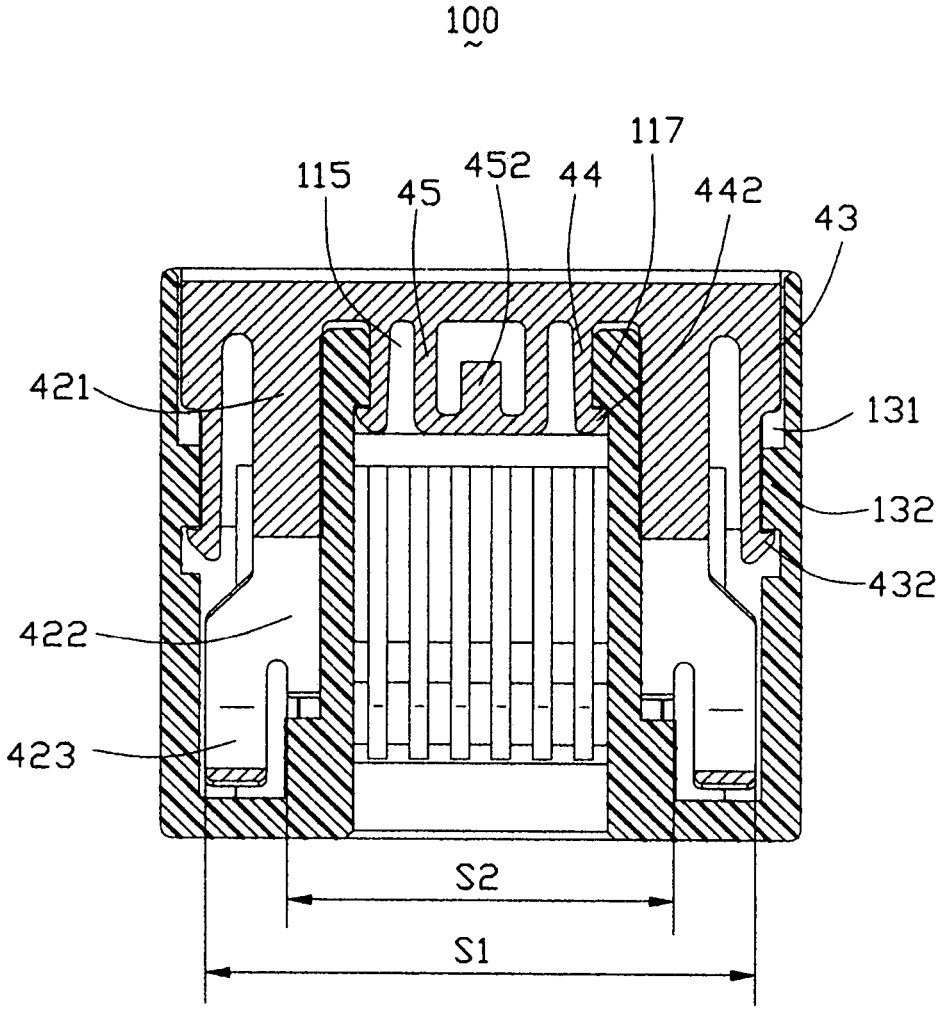
FIG. 4 is a cross-sectional view taken along line 4—4 of FIG. 1.
Figure 7:
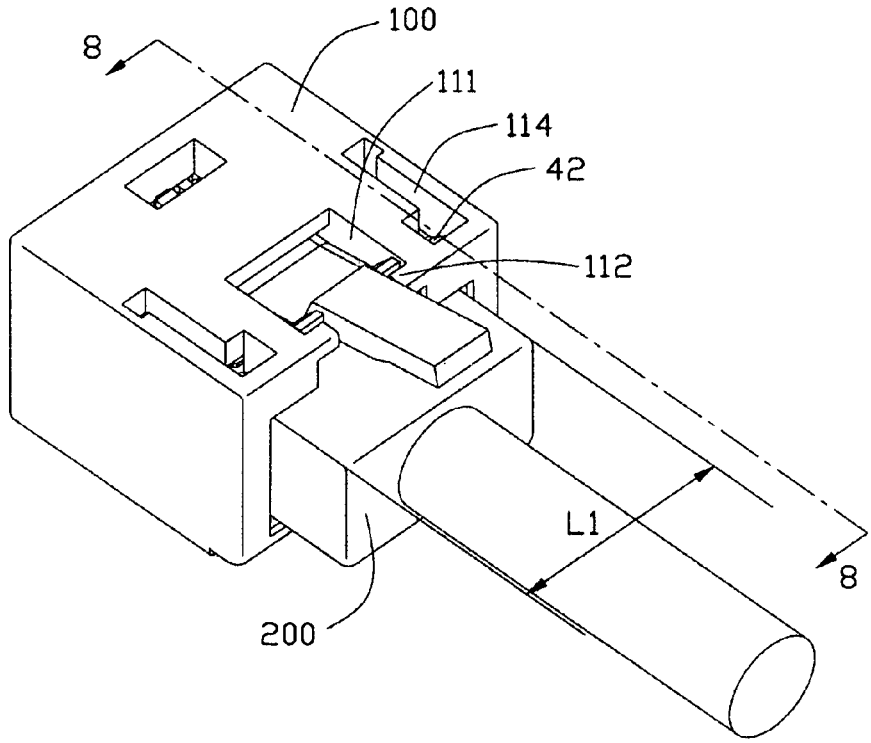
FIG. 7 is a perspective view illustrating how a full sized plug can be inserted into the modular jack.

Referring to FIGS. 2 and 4 in conjunction with FIGS. 7 and 9, the anti-mismating member 4 of the present invention is a one-piece structure stamped from a resilient metal sheet and comprises a pair of cantilevered and bifurcated prongs 42 joined by a transverse connecting wall 41. The prongs 42 extend forwardly and are substantially perpendicular to the connecting wall 41. Each prong 42 comprises a flat main portion 421, a stopping portion 422 extending slightly downwardly from an inner side of the main portion 421 and a guiding portion 423 at an outer side of the main portion 421. The outmost edges of the guiding portions 423 define a first span S1 therebetween corresponding to the first width L1 of the full sized plug 200, and the outmost edges of the stopping portions 422 define a second span S2 therebetween corresponding to the second width L2 of the undersized plug 300. The stopping portion 422 has an engaging surface 4220 formed at free end thereof and extending toward the front face 14 of the housing 1. The guiding portion 423 has an inclined driving section 4230 extending away from the stopping portion 422 and an inclined lead-in section 4232 extending forwardly and upwardly from the driving section 4230. The driving section 4230 and the lead-in section 4232 form the V-shaped guiding portion 423. In order to prevent the anti-mismating member 4 from unexpected movement, the anti-mismating member 4 further comprises a pair of first longer hook portions 43 and a pair of second shorter hook portions 44 respectively located at opposite outer sides and inner sides of the main portion 421, and a rectangular frame 45 formed between the shorter hook portions 44. The pairs of first and second hook portions 43, 44 respectively have a hook end 432, 442 outwardly extending from free ends thereof to snap the protrusions 132 and the bugles 117 of the housing 1. The frame 45 forms a raised bar 452 extending rearwardly and upwardly from front edge to enter into the aperture 113 of the housing 1. It is appreciated that the first hook portions 43, the second hook portions 44 and the frame 45 with the raised bar 452 together form foolproof retention means to create retention force for securing the anti-mismating member 4 in position when the undersized RJ-11 plug 300 erroneously mates with the modular jack 100 and is blocked by the stopping portions 422 of the prongs 42.

Figure 5:
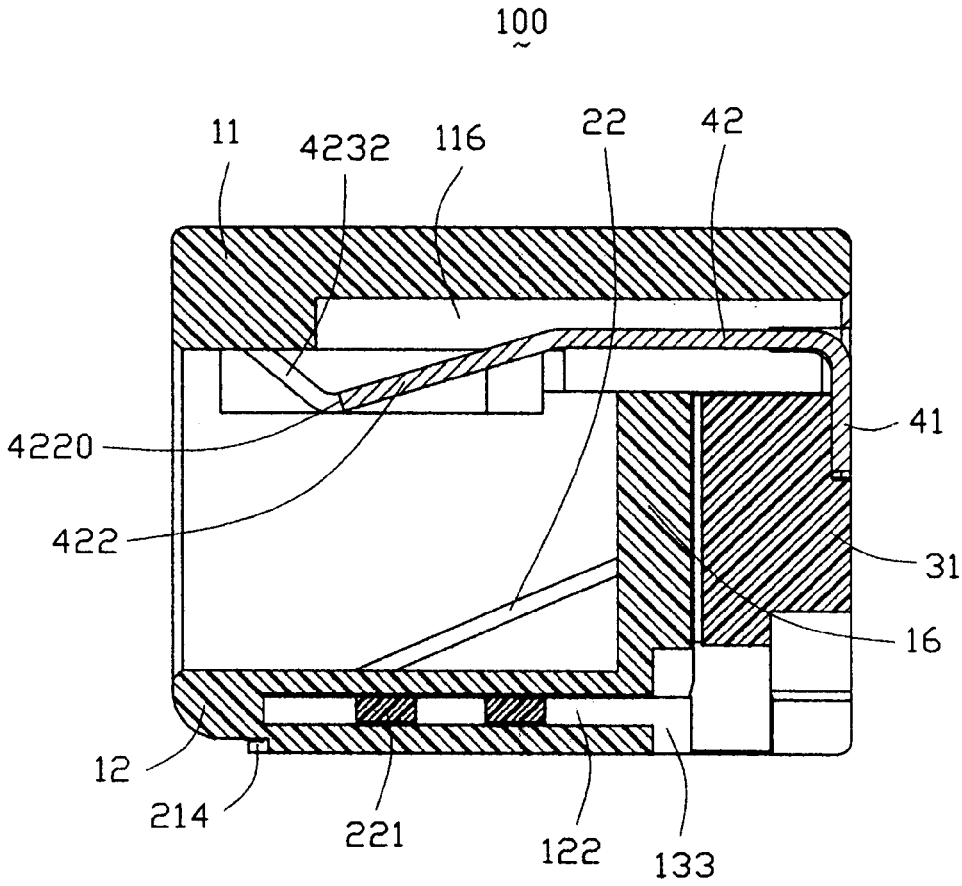
FIG. 5 is a cross-sectional view taken along line 5—5 of FIG. 1.

Referring to FIGS. 4–6 and in conjunction with FIGS. 2 and 3, in assembly, the terminal insert 2 is inserted into the housing 1 from the rear face 15 and received into the insert-receiving cavity 102 with the side portions 211 received in the lower channels 122, the stopping faces 213 bearing against corresponding inner surfaces of the second cutout 121 and the pad 214 located below the lower wall 12. The contact portions 221 of the terminals 22 extend into the plug-receiving cavity 101 with free ends thereof received in corresponding slits (not labeled) spaced defined in the vertical partition 16. The tail portions 224 of the terminals 22 are exposed in the insert-receiving cavity 102. Then, the spacer 3 is pressed into the housing 1 along a lower-to-upper direction and located behind the terminal insert 2 to space and position the tail portions 224 of the terminals 22. The latches 315 of the opposite positioning ribs 314 are initially received in and guided along the horizontal grooves 134 of the housing 1 and finally the positioning ribs 314 engagingly received in corresponding vertical slots 133 of the housing 1. At length, the anti-mismating member 4 is securely assembled to the housing 1. The connecting wall 41 abuts against rear surfaces of the sidewalls 13 of the housing 1 and the spacer 3. The first hook portions 43 extend into the second grooves 131 of the housing 1 with the first hook ends 432 snapping corresponding protrusions 132. The second hook portions 44 and the frame 45 extend into the upper channel 115 with the second hook ends 442 snapping the bulges 117 and the raised bar 452 entering into the aperture 113. The prongs 42 extend into the plug-receiving cavity 101 along the first grooves 116 of the housing 1, wherein the guiding portions 423 and the stopping portions 422 of the prongs 42 are located at the entrance of the receiving space 10 of the housing 1.

Figure 8:
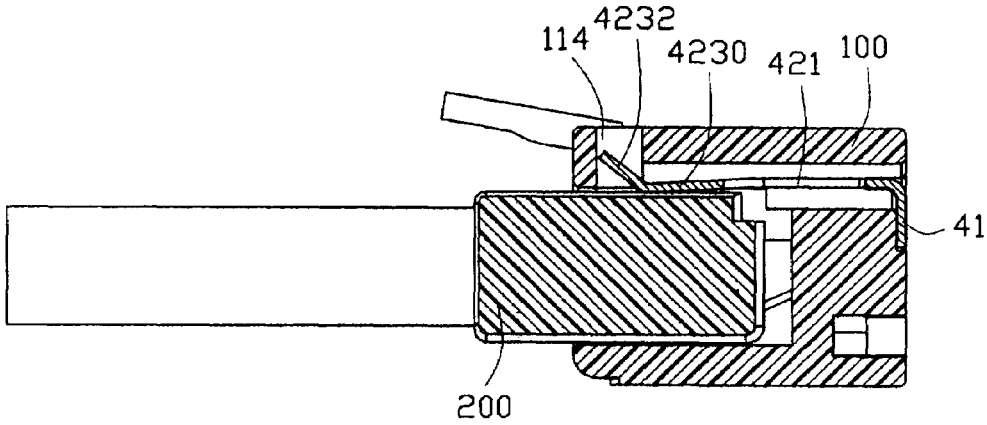
FIG. 8 is a cross-sectional view taken along line 8—8 of FIG. 7.

As an example of the operation, FIGS. 7 and 8 illustrate how the RJ-45 plug 200 is fully inserted into the modular jack 100 of the present invention. The RJ-45 plug 200 has the first width L1 and an outer profile substantially corresponding to an inner profile of the plug-receiving cavity 101 of the housing 1. When the RJ-45 plug 200 mates with the modular jack 100, an insertion end of the RJ-45 plug 200 presses against the lead-in sections 4232 of the prongs 42 of the anti-mismating member 4 so as to push and urge the driving sections 4230 to be upwardly deflected, thereby driving the stopping portions 422 to move aside and eliminate stop function and entire prongs 42 to enter into and receive in the notches 114 of the housing 1. As a result, the full sized RJ-45 plug 200 is successfully and fully and snuggly inserted into the plug-receiving cavity 101 of the modular jack 100 with header (not labeled) of the RJ-45 plug 200 entering into the first cutout 111 defined at the upper wall 11 of the housing 1, latch means (not labeled) of the header latching the retention tabs 112 of the housing 1, and contacts (not shown) of the RJ-45 plug 200 electrically mating with corresponding contact portions 221 of the terminals 22. When the inserted RJ-45 plug 200 disengages from the modular jack 100, the stopping portions 422 and the guiding portions 423 of the prongs 42 move downwardly to their normal positions.

Figure 10:
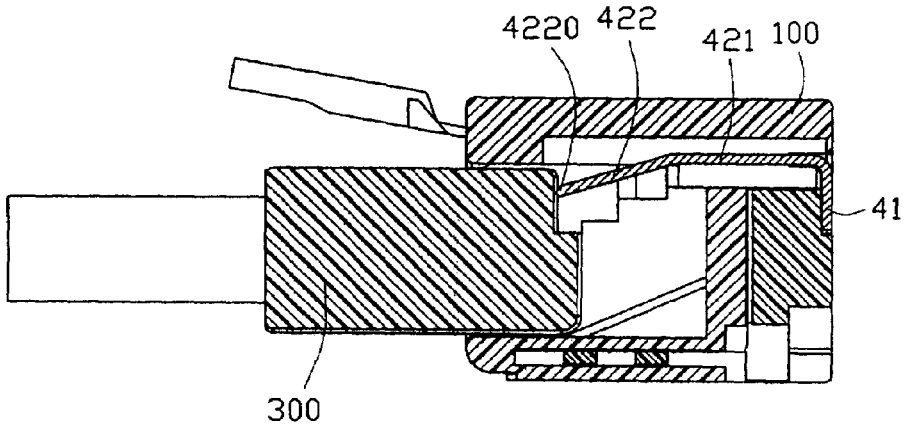
FIG. 10 is a cross-sectional view taken along line 10—10 of FIG. 9.

As another example of the operation, FIGS. 9 and 10 illustrate how the anti-mismating member 4 will prevent the RJ-11 plug 300 from being inserted into the modular jack 100. Since the RJ-11 plug 300 has the second width L2 smaller than the first width L1 of the RJ-45 plug 200, when the RJ-11 plug 300 is going to erroneously mate with the modular jack 100, the RJ-Il plug 300 will not push the lead-in sections 4232 of the prongs 42 of the anti-mismating member 4 and be blocked by the engaging surfaces 4220 of the stopping portions 422 of the prongs 42. At this position, the first and second hook portions 43, 44 of the anti-mismating member 4 stand against the protrusions 133 and the bulges 117 of the housing 1, and the raised bar 452 abuts against inner surface of the aperture 113 of the housing 1 for securing the anti-mismating member 4 in position.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack adapted for permitting proper insertion of a full sized plug and preventing erroneous insertion of an undersized plug, the modular jack comprising:

an insulative housing comprises an upper wall, a lower wall and a pair of sidewalls together defining a receiving space;

a plurality of conductive terminals received in the receiving space; and an anti-mismating member assembled to a rear face of the housing, the anti-mismating member having a pair of prongs extending into the receiving space and foolproof retention means, wherein each prong has a main portion with an inner stopping portion for blocking the undersized plug and an outer guiding portion for being urged to deflect the main portion by the full sized plug; wherein when the retention means formed in the first position, the retention means extends with the prongs in a back-to-front direction and snaps the housing to create a retention force for securing the anti-mismating member in position when the undersized plug is blocked by the stopping portions of the prongs;

when the retention means formed in the second position, the retention means extends in a slantwise direction and abuts against the housing to create an retention force for securing the anti-mismating member in position when the undersized plug is blocked by the stopping portions of the prongs; wherein the anti-mismating member further has a transverse connecting wall jointing the prongs, and wherein the prongs extend forwardly and substantially perpendicular to the connecting wall; wherein the modular jack further comprises a terminal inert assembled to a front face of the housing and having an insulative base, and wherein the base is partially cut to define a recessed area in a front region thereof; wherein the modular jack further comprises a spacer assembled to the housing behind the terminal insert; wherein the spacer is inserted into the rear face and positioned between the anti-mismating member and the terminal insert, the spacer having a pair of positioning ribs integrally formed on opposite sides of the body, each positioning rib has an outwardly extending latch in upper end thereof, and wherein the housing defines a pair of vertical slots defined in opposite inner sidewalls for receiving the positioning ribs to retain the spacer in position and a pair of horizontal grooves intersected with the vertical slots for guiding the spacer into the housing and engagingly receiving the latches.

2. The modular jack as claimed in claim 1, wherein the housing defines an upper channel extending forwardly through middle region of the upper wall, a pair of first grooves defined at opposite sides of the upper channel, and a pair of second grooves respectively recessed in the sidewalls, and wherein the upper channel, the first grooves and the second grooves communicate with one another and together form a space for receiving the anti-mismating member.

3. The modular jack as claimed in claim 2, wherein the retention means in the first position are hook portions extending with the prongs, each hook portion having a hook end at free end thereof.

4. The modular jack as claimed in claim 3, wherein the hook portions comprises a pair of first hook portions and a pair of second hook portions respectively located at opposite outer sides and inner sides of the connecting wall, and wherein the housing forms a pair of bulges and a pair of protrusions respectively on the way of the upper channel and the second grooves, the bulges and the protrusions respectively snapped by the hook ends of the first and second hook portions when the undersized plug inserted into the modular jack.

5. The modular jack as claimed in claim 4, wherein the retention means in the second position is a frame between the second hook portions with a raised bar extending rearwardly and upwardly from front edge of the frame, and wherein the upper wall of the housing defines an aperture communicating with the upper channel to be abutted against by the raised bar when the undersize plug inserted into the receiving space of the modular jack.

6. The modular jack as claimed in claim 5, wherein the upper wall of the housing further defines a pair of notches at front regions thereof communicating with the first grooves to receive the prongs therein when the full sized plug is fully inserted into the receiving space of the modular jack.

7. An electrical system comprising:

a first plug having a first width;

a second plug having a second width which is smaller than the first width; and a modular jack comprising an insulative housing defining a receiving space and an anti-mismating member assembled to the housing, the anti-mismating member comprises a connecting wall, at least one retention means extending from the connecting wall and at least a pair of prongs exposed in the receiving space, each prong having a guiding portion jointly effecting a first span corresponding to the first width, and a stopping portion jointly effecting a second span corresponding to the second width; wherein when the second plug mates with the modular jack, the second plug is limited from entrance of the receiving space by the stopping portions of the anti-mismating member;

when the first plug mates with the modular jack, the first plug engages the guiding portions of the anti-mismating member and let the stopping portions to move aside and eliminate the limitation, thereby allowing entrance of the first plug into the receiving space; wherein the retention means are hook portions extending with the prongs, each hook portion has a hook end at free end thereof; wherein the hook portions comprises a pair of first longer hook portions extending from the outmost ends of the connecting wall and a pair of second shorter hook portions located between prongs; wherein the guiding portion has an inclined driving section extending aside with the stopping portion and an inclined lead-in section extending forwardly and upwardly from the driving section, and wherein the driving section and the lead-in section form the V-shaped guiding portion; wherein the anti-mismating member is a one-piece structure stamped from a resilient metal sheet.

8. The electrical system as claimed in claim 7, wherein the retention means is a raised bar extending from the connecting wall, and wherein the housing defines an aperture engagingly receiving the raised bar.

* * * * *